US010507361B2

(12) United States Patent
Sajima et al.

(10) Patent No.: US 10,507,361 B2
(45) Date of Patent: Dec. 17, 2019

(54) GOLF BALL

(71) Applicant: DUNLOP SPORTS CO. LTD., Kobe-shi, Hyogo (JP)

(72) Inventors: Takahiro Sajima, Kobe (JP); Kohei Mimura, Kobe (JP)

(73) Assignee: SUMITOMO RUBBER INDUSTRIES, LTD., Kobe-Shi, Hyogo (JP)

( * ) Notice: Subject to any disclaimer, the term of this patent is extended or adjusted under 35 U.S.C. 154(b) by 0 days.

(21) Appl. No.: 15/663,036

(22) Filed: Jul. 28, 2017

(65) Prior Publication Data

US 2018/0056138 A1 Mar. 1, 2018

(30) Foreign Application Priority Data

Aug. 29, 2016 (JP) ..... 2016-166388
Aug. 29, 2016 (JP) ..... 2016-166389

(51) Int. Cl.
*A63B 37/00* (2006.01)
*A63B 37/14* (2006.01)

(52) U.S. Cl.
CPC ..... *A63B 37/0006* (2013.01); *A63B 37/0004* (2013.01); *A63B 37/0005* (2013.01); *A63B 37/0016* (2013.01); *A63B 37/0017* (2013.01); *A63B 37/0021* (2013.01); *A63B 37/0022* (2013.01); *A63B 37/0075* (2013.01); *A63B 37/0076* (2013.01); *A63B 37/0045* (2013.01); *A63B 37/0047* (2013.01); *A63B 37/0056* (2013.01); *A63B 37/0064* (2013.01); *A63B 37/14* (2013.01)

(58) Field of Classification Search
CPC . A63B 37/0004; A63B 37/0005; A63B 37/14; A63B 37/0003
See application file for complete search history.

(56) References Cited

U.S. PATENT DOCUMENTS 4,438,924 A * 3/1984 Carr ..... A63B 37/14 473/613
2015/0182805 A1* 7/2015 Sajima ..... A63B 37/0022 473/376
2016/0067552 A1* 3/2016 Hixenbaugh ..... A63B 37/0015 473/383
2016/0339302 A1* 11/2016 Nardacci ..... A63B 37/0015

* cited by examiner

*Primary Examiner* — John E Simms, Jr.
(74) *Attorney, Agent, or Firm* — Birch, Stewart, Kolasch & Birch LLP

(57) ABSTRACT

A golf ball has a plurality of dimples 12 and a land 14 on a surface thereof. The golf ball further has a large number of minute projections 18 formed on surfaces of the dimples 12 and the land 14. An average pitch Pav of these minute projections 18 is less than 100 μm. An average height Hav of these minute projections 18 is not less than 0.5 μm and not greater than 50 μm. The golf ball satisfies the following mathematical formula.

$$Lav<3*Tav$$

In the mathematical formula, Lav represents an average value of distances L between the minute projections 18 and other minute projections 18 adjacent to the minute projections 18, and Tav represents an average value of widths T of these minute projections 18.

9 Claims, 10 Drawing Sheets

GOLF BALL

This application claims priority on Patent Application Nos. 2016-166388 and 2016-166389 filed in JAPAN on Aug. 29, 2016. The entire contents of these Japanese Patent Applications are hereby incorporated by reference.

BACKGROUND OF THE INVENTION

Field of the Invention

The present invention relates to golf balls. Specifically, the present invention relates to golf balls having dimples on the surfaces thereof.

Description of the Related Art

Golf balls have a large number of dimples on the surfaces thereof. The dimples enhance the aerodynamic characteristics of the golf balls.

A golf ball having minute projections and minute recesses together with dimples has been proposed. The projections and the recesses can contribute to aerodynamic characteristic, spin performance, appearance, ease of production, and the like.

JP2015-142599 (US2015/0182805) discloses a golf ball including a paint layer having large roughness. The roughness can be formed by blasting or the like. The paint layer enhances the aerodynamic characteristic of the golf ball.

A golf ball that is hit with a golf club flies in the air. The golf ball falls and rolls on the ground. At the time of falling and at the time of rolling, the golf ball comes into contact with the ground. As a result of the contact, soil or mud may adhere to the surface of the golf ball to soil the surface. When a golf ball is on a fairway or rough, a golf player cannot touch the golf ball. Therefore, the golf player cannot remove dirt on the golf ball. On a green, a golf player can remove dirt on a golf ball. However, the work for the removal takes time and effort. In some cases, the dirt cannot be sufficiently removed even through the work. In some cases, the dirt is not removed even by washing the golf ball with water. The golf ball having the dirt remaining thereon is replaced. The replacement imposes an economic burden on the golf player.

Soil and mud easily adhere to the golf ball disclosed in JP2015-142599, since the roughness of the paint layer is great. The anti-soiling property of the golf ball is not sufficient. Even when the golf ball is washed with water, it is difficult to remove soil and mud from the golf ball. The cleanability of the golf ball is not sufficient.

An object of the present invention is to provide a golf ball having an excellent anti-soiling property and cleanability.

SUMMARY OF THE INVENTION

A golf ball according to the present invention has a plurality of dimples and a land. The golf ball further has a large number of minute projections formed on surfaces of the dimples and/or the land. An average pitch Pav of the minute projections is less than 100 μm.

Preferably, an average height Hav of the minute projections is not less than 0.5 μm and not greater than 50 μm.

Preferably, the golf ball satisfies the following mathematical formula:

$$Lav<3*Tav,$$

wherein Lav represents an average value of distances L between the minute projections and other minute projections adjacent to the minute projections, and Tav represents an average value of widths T of the minute projections.

The golf ball can have a plurality of rows. Preferably, in each of the rows, a plurality of minute projections are aligned at equal pitches.

The golf ball can include a main body and a paint layer positioned outside the main body. Preferably, the minute projections each have a shape in which a surface shape of the main body is reflected.

According to another aspect, a golf ball according to the present invention has a plurality of dimples and a land. The golf ball further has a large number of minute projections formed on surfaces of the dimples and/or the land. An average pitch Pav of the minute projections is not less than 100 μm.

Preferably, an average height Hav of the minute projections is not less than 0.5 μm and not greater than 50 μm.

Preferably, the golf ball satisfies the following mathematical formula:

$$Lav>0.5*Tav,$$

wherein Lav represents an average value of distances L between the minute projections and other minute projections adjacent to the minute projections, and Tav represents an average value of widths T of the minute projections.

The golf ball can have a plurality of rows. Preferably, in each of the rows, a plurality of minute projections are aligned at equal pitches.

The golf ball can include a main body and a paint layer positioned outside the main body. Preferably, the minute projections each have a shape in which a surface shape of the main body is reflected.

DESCRIPTION OF THE PREFERRED EMBODIMENTS

The following will describe in detail the present invention based on preferred embodiments with appropriate reference to the drawings.

First Embodiment

Figure 1:
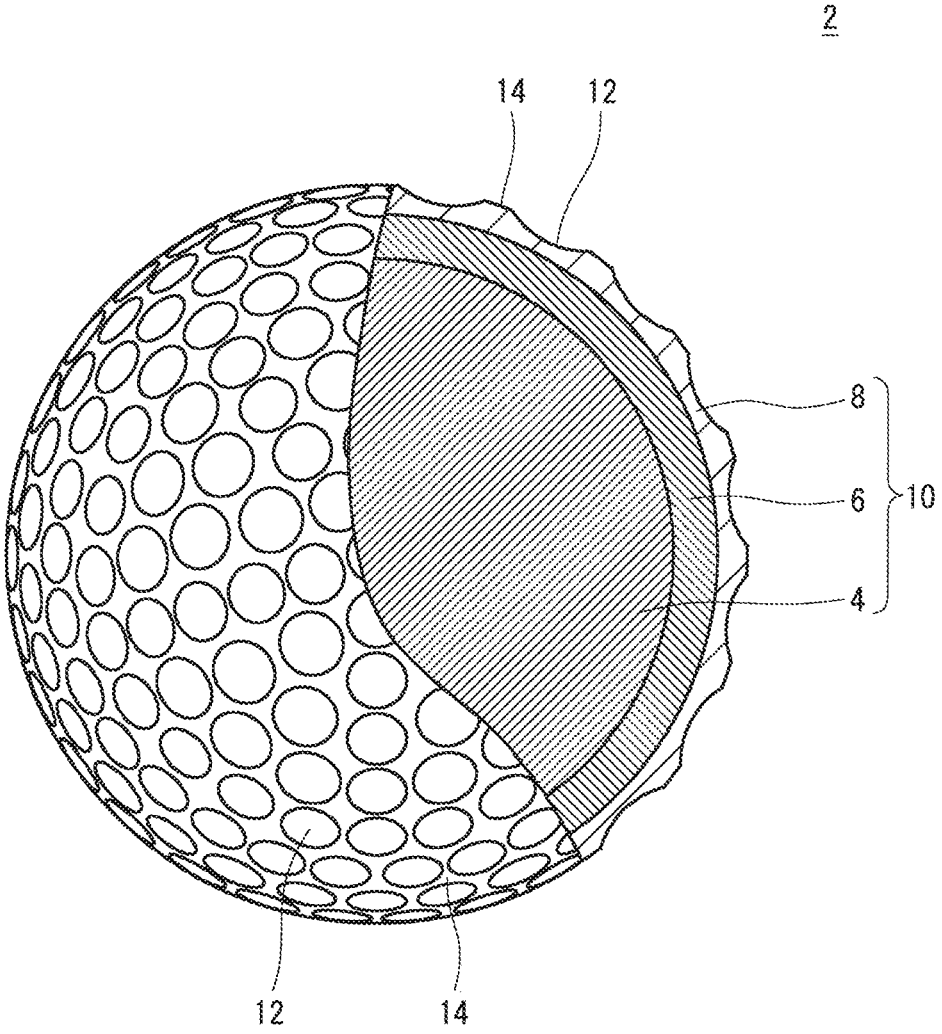
FIG. 1 is a partially cutaway cross-sectional view of a golf ball according to one embodiment of the present invention.

A golf ball 2 shown in FIG. 1 includes a spherical core 4, a mid layer 6 positioned outside the core 4, and a cover 8 positioned outside the mid layer 6. The core 4, the mid layer 6, and the cover 8 are included in a main body 10 of the golf ball 2. The golf ball 2 has a large number of dimples 12 on the surface thereof. Of the surface of the golf ball 2, a part other than the dimples 12 is a land 14. Although not shown in FIG. 1, the golf ball 2 further includes a later-described paint layer. The paint layer is positioned outside the main body 10. The main body 10 may have a one-piece structure. The main body 10 may have a two-piece structure, a four-piece structure, a five-piece structure, or the like.

The golf ball 2 preferably has a diameter of not less than 40 mm and not greater than 45 mm. From the standpoint of conformity to the rules established by the United States Golf Association (USGA), the diameter is particularly preferably not less than 42.67 mm. In light of suppression of air resistance, the diameter is more preferably not greater than 44 mm and particularly preferably not greater than 42.80 mm. The diameter of the golf ball 2 according to the present embodiment is 42.7 mm.

The golf ball 2 preferably has a weight of not less than 40 g and not greater than 50 g. In light of attainment of great inertia, the weight is more preferably not less than 44 g and particularly preferably not less than 45.00 g. From the standpoint of conformity to the rules established by the USGA, the weight is particularly preferably not greater than 45.93 g.

The core 4 is formed by crosslinking a rubber composition. Examples of the base rubber of the rubber composition include polybutadienes, polyisoprenes, styrene-butadiene copolymers, ethylene-propylene-diene copolymers, and natural rubbers. Two or more rubbers may be used in combination. In light of resilience performance, polybutadienes are preferable, and high-cis polybutadienes are particularly preferable.

The rubber composition of the core 4 includes a co-crosslinking agent. Examples of preferable co-crosslinking agents in light of resilience performance include zinc acrylate, magnesium acrylate, zinc methacrylate, and magnesium methacrylate. The rubber composition preferably includes an organic peroxide together with a co-crosslinking agent. Examples of preferable organic peroxides include dicumyl peroxide, 1,1-bis(t-butylperoxy)-3,3,5-trimethylcyclohexane, 2,5-dimethyl-2,5-di(t-butylperoxy)hexane, and di-t-butyl peroxide.

The rubber composition of the core 4 may include additives such as a filler, sulfur, a vulcanization accelerator, a sulfur compound, an anti-aging agent, a coloring agent, a plasticizer, and a dispersant. The rubber composition may include a carboxylic acid or a carboxylate. The rubber composition may include synthetic resin powder or cross-linked rubber powder.

The core 4 has a diameter of preferably not less than 30.0 mm and particularly preferably not less than 38.0 mm. The diameter of the core 4 is preferably not greater than 42.0 mm and particularly preferably not greater than 41.5 mm. The core 4 may have two or more layers. The core 4 may have a rib on the surface thereof. The core 4 may be hollow.

The mid layer 6 is formed from a resin composition. A preferable base polymer of the resin composition is an ionomer resin. Examples of preferable ionomer resins include binary copolymers formed with an α-olefin and an α,β-unsaturated carboxylic acid having 3 to 8 carbon atoms. Examples of other preferable ionomer resins include ternary copolymers formed with: an α-olefin; an α,β-unsaturated carboxylic acid having 3 to 8 carbon atoms; and an α,β-unsaturated carboxylate ester having 2 to 22 carbon atoms. For the binary copolymer and the ternary copolymer, preferable α-olefins are ethylene and propylene, while preferable α,β-unsaturated carboxylic acids are acrylic acid and methacrylic acid. In the binary copolymer and the ternary copolymer, some of the carboxyl groups are neutralized with metal ions. Examples of metal ions for use in neutralization include sodium ion, potassium ion, lithium ion, zinc ion, calcium ion, magnesium ion, aluminum ion, and neodymium ion.

Instead of an ionomer resin, the resin composition of the mid layer 6 may include another polymer. Examples of the other polymer include polystyrenes, polyamides, polyesters, polyolefins, and polyurethanes. The resin composition may include two or more polymers.

The resin composition of the mid layer 6 may include a coloring agent such as titanium dioxide, a filler such as barium sulfate, a dispersant, an antioxidant, an ultraviolet absorber, a light stabilizer, a fluorescent material, a fluorescent brightener, and the like. For the purpose of adjusting specific gravity, the resin composition may include powder of a metal with a high specific gravity such as tungsten, molybdenum, and the like.

The mid layer 6 has a thickness of preferably not less than 0.2 mm and particularly preferably not less than 0.3 mm. The thickness of the mid layer 6 is preferably not greater than 2.5 mm and particularly preferably not greater than 2.2 mm. The mid layer 6 has a specific gravity of preferably not less than 0.90 and particularly preferably not less than 0.95. The specific gravity of the mid layer 6 is preferably not greater than 1.10 and particularly preferably not greater than 1.05. The mid layer 6 may have two or more layers.

The cover 8 is formed from a resin composition. A preferable base polymer of the resin composition is an ionomer resin. The golf ball 2 that includes the cover 8 including the ionomer resin has excellent resilience performance. The ionomer resins described above for the mid layer 6 can be used for the cover 8.

Instead of an ionomer resin, the resin composition of the cover 8 may include another polymer. Examples of the other polymer include polystyrenes, polyamides, polyesters, polyolefins, and polyurethanes. The resin composition may include two or more polymers.

The resin composition of the cover 8 may include a coloring agent, a filler, a dispersant, an antioxidant, an ultraviolet absorber, a light stabilizer, a fluorescent material, a fluorescent brightener, and the like in an adequate amount. When the hue of the golf ball 2 is white, a typical coloring agent is titanium dioxide.

The cover 8 has a thickness of preferably not less than 0.2 mm, more preferably not less than 0.4 mm, and particularly preferably not less than 0.6 mm. The thickness of the cover 8 is preferably not greater than 2.5 mm and particularly preferably not greater than 2.2 mm. The cover 8 has a specific gravity of preferably not less than 0.90 and particularly preferably not less than 0.95. The specific gravity of the cover 8 is preferably not greater than 1.10 and particularly preferably not greater than 1.05.

Figure 2:
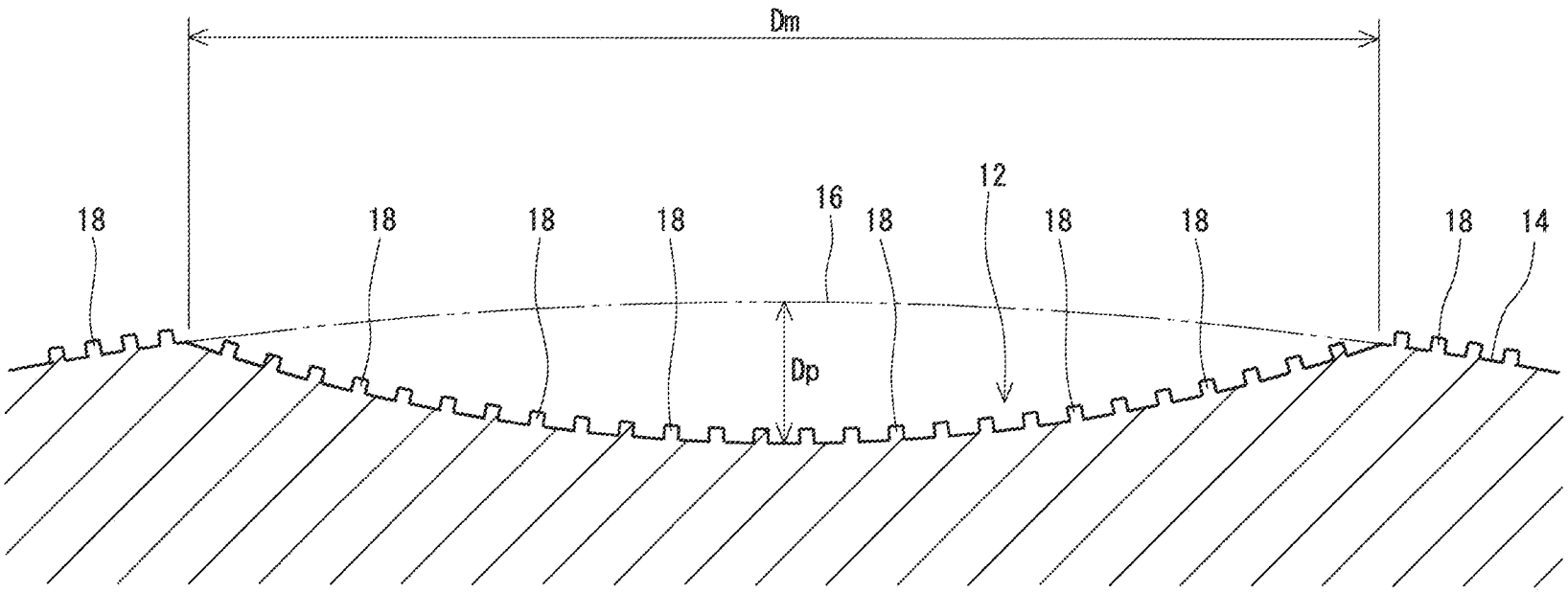
FIG. 2 is a partially enlarged cross-sectional view of the golf ball in FIG. 1.

FIG. 2 shows a cross section of the golf ball 2 along a plane passing through the central point of the dimple 12 and the central point of the golf ball 2. In FIG. 2, the top-to-bottom direction is the depth direction of the dimple 12. In FIG. 2, a chain double-dashed line 16 indicates a phantom sphere. The surface of the phantom sphere 16 is the surface of the golf ball 2 when it is postulated that no dimple 12 and no minute projection (described in detail later) exist. The diameter of the phantom sphere 16 is equal to the diameter of the golf ball 2. The dimple 12 is recessed from the surface of the phantom sphere 16. The land 14 coincides with the surface of the phantom sphere 16.

In FIG. 2, an arrow Dm indicates the diameter of the dimple 12. The diameter Dm of each dimple 12 is preferably not less than 2.0 mm and not greater than 6.0 mm. In FIG. 2, a double ended arrow Dp indicates the depth of the dimple 12. The depth Dp is the distance between the deepest part of the dimple 12 and the surface of the phantom sphere 16. The depth Dp is preferably not less than 0.10 mm and not greater than 0.65 mm.

The area S of the dimple 12 is the area of a region surrounded by the contour line of the dimple 12 when the central point of the golf ball 2 is viewed at infinity. In the case of a circular dimple 12, the area S is calculated by the following mathematical formula.

$$S=(Dm/2)^2*\pi$$

In the present invention, the ratio of the sum of the areas S of all the dimples 12 relative to the surface area of the phantom sphere 16 is referred to as an occupation ratio. From the standpoint that sufficient turbulization is achieved, the occupation ratio So is preferably not less than 75%. The occupation ratio So is preferably not greater than 95%.

From the standpoint that a sufficient occupation ratio is achieved, the total number N of the dimples 12 is preferably not less than 250. From the standpoint that each dimple 12 can contribute to turbulization, the total number N of the dimples 10 is preferably not greater than 450.

In the present invention, the "volume of the dimple" means the volume of a portion surrounded by the surface of the phantom sphere 16 and the surface of the dimple 12. In light of suppression of rising of the golf ball 2 during flight, the total volume of all the dimples 12 is preferably not less than 450 $mm^3$. In light of suppression of dropping of the golf ball 2 during flight, the total volume is preferably not greater than 750 $mm^3$.

Figure 3:
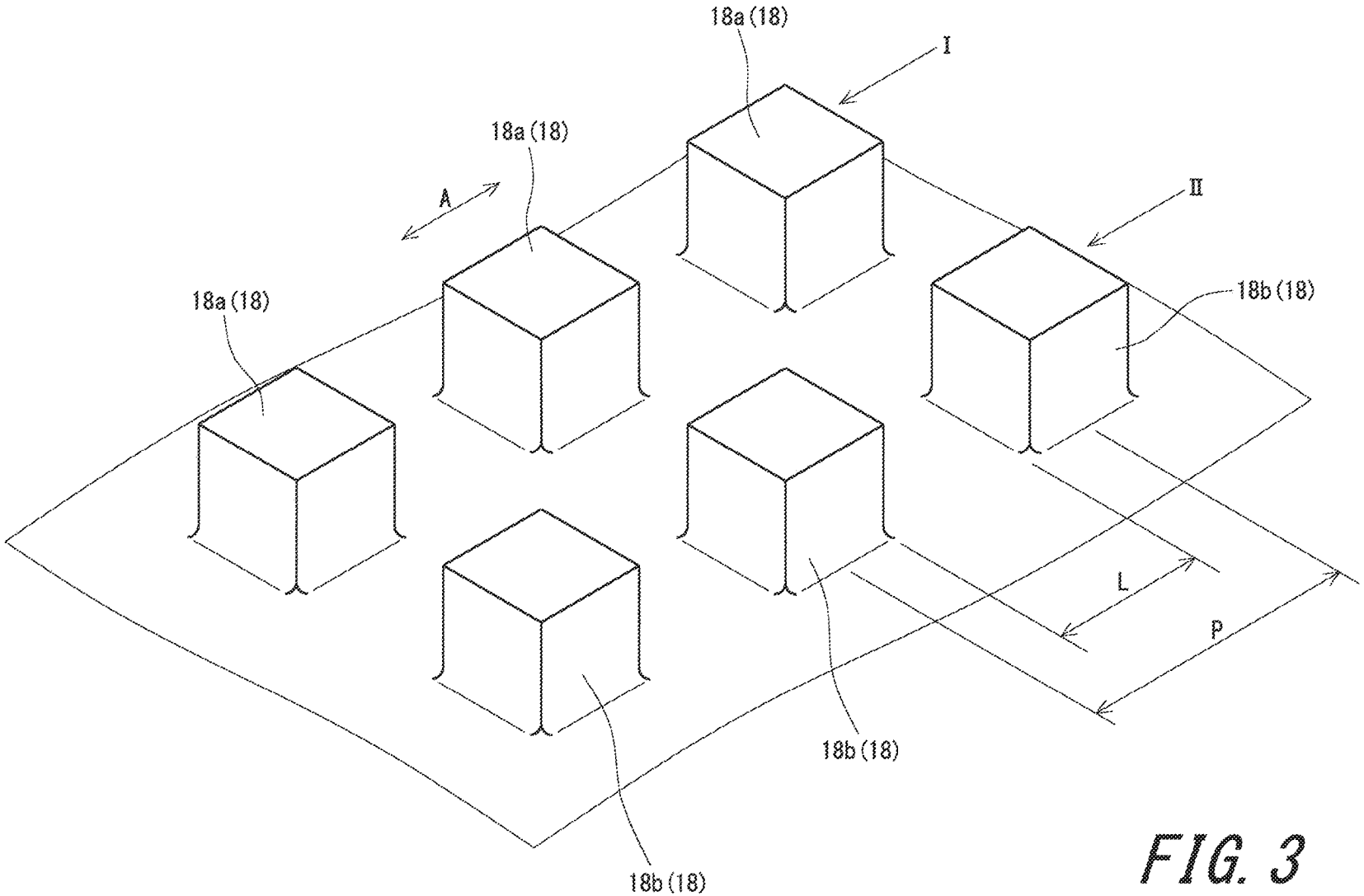
FIG. 3 is a partially enlarged perspective view of the surface of the golf ball in FIG. 1.

FIG. 3 is a partially enlarged perspective view of the surface of the golf ball 2 in FIG. 1. As is obvious from FIG. 3, the golf ball 2 has a large number of minute projections 18 on the surface thereof. As is obvious from FIG. 2, the minute projections 18 are formed on the surfaces of the dimples 12 and also on the surface of the land 14. Each minute projection 18 stands outward in the radial direction of the golf ball 2. The minute projections 18 may be formed only on the surfaces of the dimples 12. The minute projections 18 may be formed only on the surface of the land 14.

FIG. 3 shows three minute projections 18*a* belonging to a first row I, and three minute projections 18*b* belonging to a second row II. The direction indicated by an arrow A in FIG. 3 is the direction in which the rows extend. In each row, the minute projections 18 are aligned at equal pitches. In other words, the minute projections 18 are regularly aligned. At a part of the surface of the golf ball 2, the minute projections 18 may be irregularly aligned.

The minute projections 18*a*, which belong to the first row I, and the minute projections 18*b*, which belong to the second row II, may be arranged zigzag. In other words, the positions of the minute projections 18*a*, which belong to the first row I, may be displaced relative to the positions of the minute projections 18*b*, which belong to the second row II, in the extending direction A.

Figure 4:
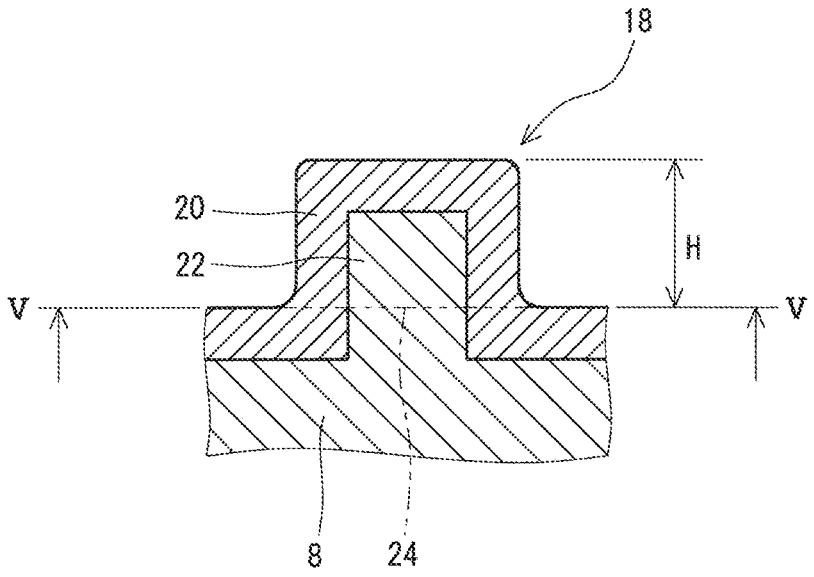
FIG. 4 is a partially enlarged cross-sectional view of the golf ball in FIG. 1.

FIG. 4 is a partially enlarged cross-sectional view of the golf ball 2 in FIG. 1. FIG. 4 shows the cover 8, which is a part of the main body 10, and a paint layer 20. FIG. 4 shows the minute projection 18. The cover 8 has a projection portion 22. The minute projection 18 is formed by the projection portion 22 and the paint layer 20. The projection portion 22 stands outward in the radial direction of the golf ball 2 (upward in FIG. 4). Thus, the minute projection 18 also stands outward in the radial direction of the golf ball 2. In other words, the minute projection 18 has a shape in which the surface shape of the main body 10 (cover 8) is reflected. In FIG. 4, reference sign 24 indicates the bottom surface of the minute projection 18.

Figure 5:
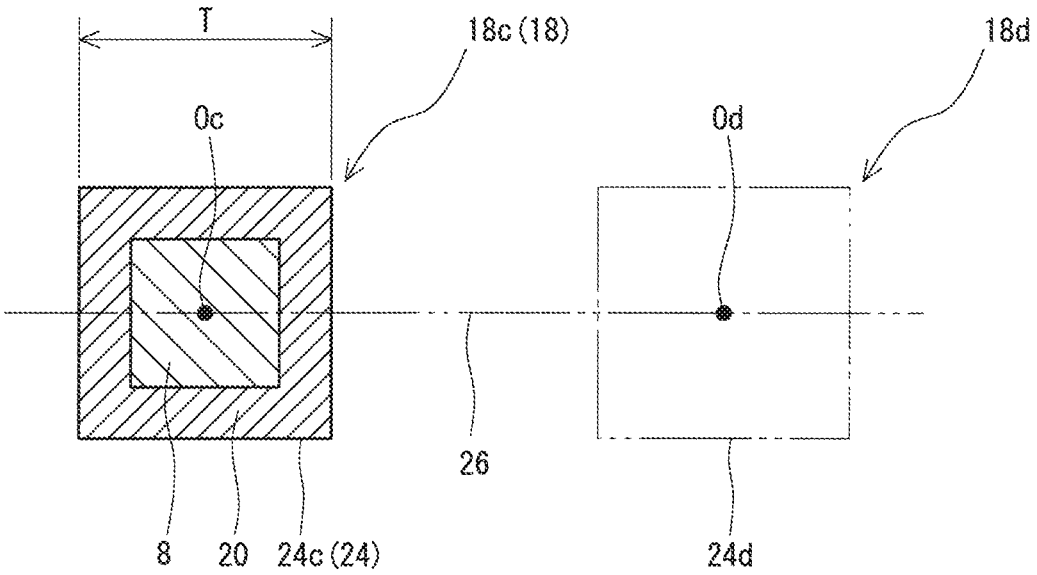
FIG. 5 is a cross-sectional view taken along the line V-V in FIG. 4.

FIG. 5 is a cross-sectional view taken along the line V-V in FIG. 4. FIG. 5 shows the bottom surface 24 of the minute projection 18. The bottom surface 24 includes the cover 8 and the paint layer 20.

In FIG. 3, an arrow P indicates a pitch. The pitch P is the distance between a first minute projection 18 and a second minute projection 18 adjacent to the first minute projection 18. The pitch P is the distance between the center of gravity of a bottom surface 24 of the first minute projection 18 and the center of gravity of a bottom surface 24 of the second minute projection 18. The "second minute projection adjacent to the first minute projection" is the minute projection 18 having a smallest distance to the first minute projection 18, among the minute projections 18 present around the first minute projection 18. The "distance" is the distance between the centers of gravity of the bottom surfaces 24 of the minute projections 18.

For each minute projection 18, one pitch P is determined. An average pitch Pav is calculated by summing the pitches P of all the minute projections 18 and dividing the sum of the pitches P by the number of the minute projections 18. The average pitch Pav is preferably less than 100 μm. Particles of soil are less likely to adhere to the golf ball 2 in which the average pitch Pav is less than 100 μm. The golf ball 2 has an excellent anti-soiling property. On the golf ball 2 in which the average pitch Pav is less than 100 μm, water drops are less likely to enter between each minute projection 18 and the minute projection 18 adjacent thereto. Therefore, even when the surface of the minute projection 18 is soiled, if the minute projection 18 is washed with water, the water flows while taking in the dirt. The golf ball 2 has excellent cleanability. In light of anti-soiling property and cleanability, the average pitch Pav is more preferably not greater than 95 μm and particularly preferably not greater than 80 μm. From the standpoint that foreign matter is less likely to adhere to each minute projection 18, the average pitch Pav is preferably not less than 10 μm, more preferably not less than 15 μm, and particularly preferably not less than 20 μm.

In FIG. 3, an arrow L indicates the distance between the first minute projection 18 and the second minute projection 18 adjacent to the first minute projection 18. The direction of the distance L is the same as the direction of the pitch P.

For each minute projection 18, one distance L is determined. An average distance Lav is calculated by summing the distances L of all the minute projections 18 and dividing the sum of the distances L by the number of the minute projections 18. From the standpoint that particles of soil are less likely to adhere, the average distance Lav is preferably not less than 10 μm, more preferably not less than 15 μm, and particularly preferably not less than 20 μm. In light of cleanability, the average distance Lav is preferably not greater than 80 μm, more preferably not greater than 75 μm, and particularly preferably not greater than 70 μm.

FIG. 5 shows a bottom surface 24*c* of a first minute projection 18*c* and also shows a bottom surface 24*d* of a second minute projection 18*d* by an alternate long and two short dashes line. The second minute projection 18*d* is adjacent to the first minute projection 18*c*. In FIG. 5, an alternate long and two short dashes line 26 represents a straight line passing through the center of gravity Oc of the bottom surface 24*c* of the first minute projection 18*c* and the center of gravity Od of the bottom surface 24*d* of the second minute projection 18*d*. In FIG. 5, an arrow T indicates a width of the first minute projection 18*c*. The width T is measured along the straight line 26. The width T is the distance of a portion included in the contour of the bottom surface 24*c*, of the straight line 26.

Figure 6:
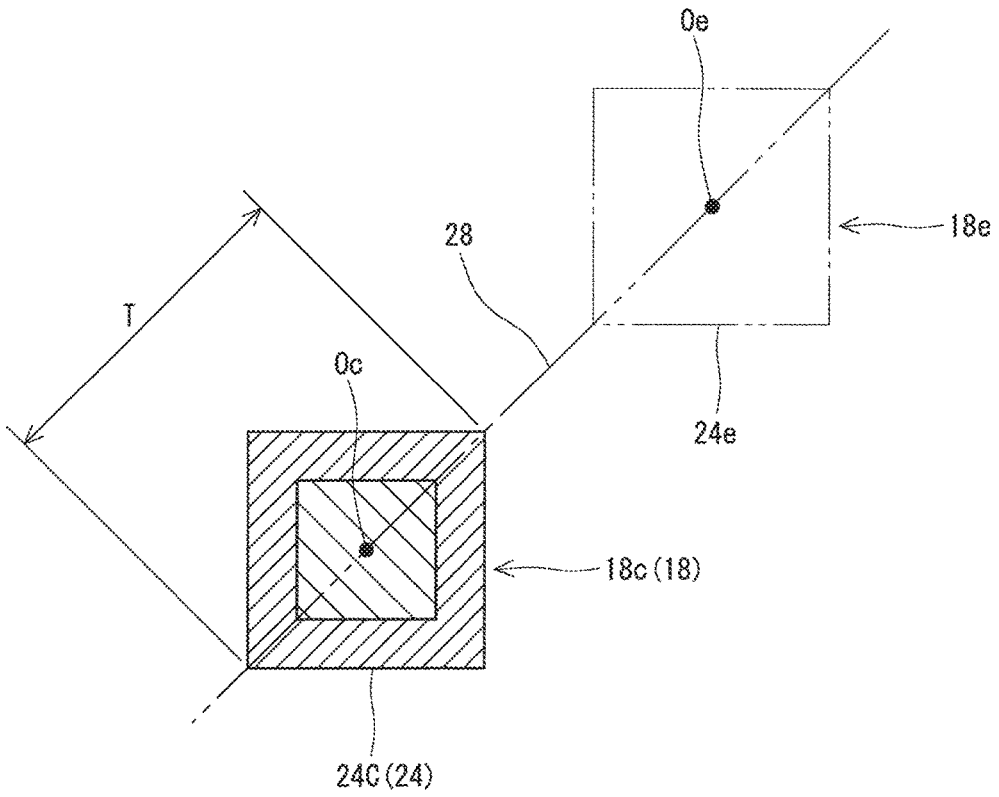
FIG. 6 is a partially enlarged cross-sectional view of the golf ball in FIG. 1.

FIG. 6 shows the bottom surface 24*c* of the first minute projection 18*c* and also shows a bottom surface 24*e* of a second minute projection 18*e* by an alternate long and two short dashes line. The second minute projection 18*e* is adjacent to the first minute projection 18*c*. In FIG. 6, an alternate long and two short dashes line 28 represents a straight line passing through the center of gravity Oc of the bottom surface 24*c* of the first minute projection 18*c* and the center of gravity Oe of the bottom surface 24*e* of the second minute projection 18*e*. In FIG. 6, an arrow T indicates a width of the first minute projection 18*c*. The width T is measured along the straight line 28. The width T is the distance of a portion included in the contour of the bottom surface 24*c*, of the straight line 28. The width T shown in FIG. 6 is larger than the width T shown in FIG. 5.

The distance between the first minute projection 18*c* and the second minute projection 18*d* shown in FIG. 5 is equal to the distance between the first minute projection 18*c* and the second minute projection 18*e* shown in FIG. 6. The first minute projection 18*c* is adjacent to the two second minute projections 18*d* and 18*e*. Therefore, the first minute projection 18*c* can have a plurality of widths T. In this case, the largest width T is adopted as the width of the first minute projection 18*c*.

For each minute projection 18, one width T is determined. An average width Tav is calculated by summing the widths T of all the minute projections 18 and dividing the sum of the widths T by the number of the minute projections 18. From the standpoint that particles of soil are less likely to adhere, the average width Tav is preferably not less than 10 μm, more preferably not less than 15 μm, and particularly preferably not less than 20 μm. From the standpoint that the top surfaces of the minute projections 18 are less likely to be soiled, the average width Tav is preferably not greater than 60 μm, more preferably not greater than 50 μm, and particularly preferably not greater than 40 μm.

The golf ball 2 satisfies the following mathematical formula.

$$Lav<3*Tav$$

In the golf ball 2, the density of the minute projections 18 is high. Particles of soil are less likely to adhere to the golf ball 2. Therefore, the golf ball 2 has an excellent anti-soiling property and cleanability. In light of anti-soiling property and cleanability, the golf ball 2 preferably satisfies the following mathematical formula.

$$Lav\leq 2*Tav$$

The golf ball 2 preferably satisfies the following mathematical formula.

$$Lav>Tav$$

In FIG. 4, an arrow H indicates the height of the minute projection 18. The height H is measured along the radial direction of the golf ball 2. An average height Hav is calculated by summing the heights H of all the minute projections 18 and dividing the sum of the heights H by the number of the minute projections 18. From the standpoint that particles of soil are less likely to adhere, the average height Hav is preferably not less than 0.5 μm, more preferably not less than 1.0 μm, and particularly preferably not less than 2.0 μm. In light of flight performance of the golf ball 2, the average height Hav is preferably not greater than 50 μm, more preferably not greater than 40 μm, and particularly preferably not greater than 30 μm.

From the standpoint that particles of soil are less likely to adhere, the average area of the bottom surfaces 24 is preferably not less than 100 $\mu m^2$, more preferably not less than 225 $\mu m^2$, and particularly preferably not less than 400 $\mu m^2$. From the standpoint that the top surfaces of the minute projections 18 are less likely to be soiled, the average area is preferably not greater than 3600 $\mu m^2$, more preferably not greater than 2500 $\mu m^2$, and particularly preferably not greater than 1600 $\mu m^2$.

From the standpoint that particles of soil are less likely to adhere, the ratio of the total area of the bottom surfaces 24 of all the minute projections 18 relative to the surface area of the phantom sphere 16 is preferably not less than 5%, more preferably not less than 15%, and particularly preferably not less than 20%. From the standpoint that the top surfaces of the minute projections 18 are less likely to be soiled, the ratio is preferably not greater than 80%, more preferably not greater than 60%, and particularly preferably not greater than 50%.

In light of anti-soiling property and cleanability, the total number of the minute projections 18 is preferably not less than 500, more preferably not less than 1000, and particularly preferably not less than 2000. In light of anti-soiling property, the total number is preferably not greater than 500000, more preferably not greater than 300000, and particularly preferably not greater than 100000.

As described above, each minute projection 18 includes the projection portion 22 of the main body 10 and the paint layer 20 (see FIG. 4). Therefore, even when the paint layer 20 is separated from the main body 10, the shapes of the minute projections 18 are substantially maintained. A special paint is not needed for forming the minute projections 18. The golf ball 2 can easily be produced.

Soiling of the golf ball 2 is prevented by a physical effect of the minute projections 18. Therefore, it is not necessary to use a cover 8 and a paint layer 20 that have special chemical properties for the purpose of preventing soiling.

The projection portions 22 of the main body 10 are formed simultaneously with formation of the main body 10. For the formation, a mold is used. The cavity face of the mold has a large number of minute recesses. Each recess has a shape that is substantially the inverted shape of the projection portion 22. The mold can be obtained from a master mold. One example of a method for producing the master mold is etching. During etching, a large number of minute maskings are used. By the maskings, projection portions are formed on the master mold. By the projection portions of the master mold, recesses are formed on the mold. The positions of the maskings correspond to the positions of the projection portions of the master mold, correspond to the positions of the recesses of the mold, and correspond to the positions of the minute projections 18 of the golf ball 2. The master mold can be produced by various methods other than etching. Examples of a method other than etching include laser radiation processing.

As described above, the minute projections 18 are formed on the surfaces of the dimples 12 and also on the surface of the land 14 (see FIG. 2). The minute projections 18 prevent soiling of the dimples 12 and also prevent soiling of the land 14.

The shape of each minute projection 18 shown in FIGS. 2 to 6 is substantially a square prism. The golf ball 2 may have minute projections having other shape. Examples of the other shape include a prism other than a square prism, a circular column, a truncated pyramid, a truncated cone, a pyramid, and a cone. The shape of each minute projection may be a part of a sphere. Each minute projection may have a shape obtained by combining a plurality of solids.

Second Embodiment

Figure 7:
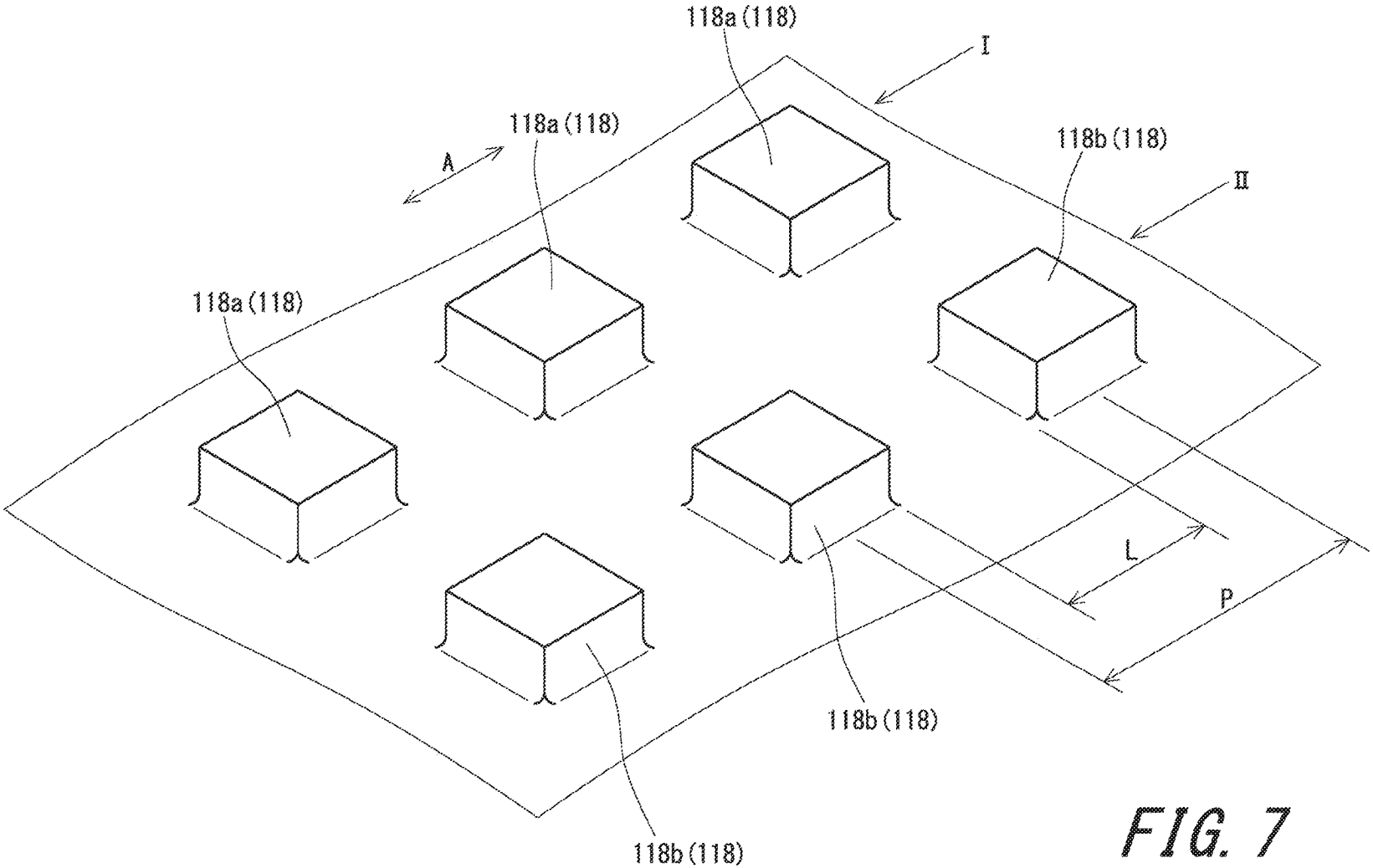
FIG. 7 is a partially enlarged perspective view of the surface of a golf ball according to another embodiment of the present invention.

FIG. 7 is a partially enlarged perspective view of the surface of a golf ball according to another embodiment of the present invention. Similarly to the golf ball 2 shown in FIGS. 1 to 6, the golf ball includes a main body and a paint layer. The main body includes a spherical core, a mid layer positioned outside the core, and a cover positioned outside the mid layer. Similarly to the golf ball 2 shown in FIGS. 1 to 6, the golf ball further has a plurality of dimples and a land.

As is obvious from FIG. 7, the golf ball has a large number of minute projections 118 on the surface thereof. The minute projections 118 are formed on the surfaces of the dimples and also on the surface of the land. Each minute projection 118 stands outward in the radial direction of the golf ball. The minute projections 118 may be formed only on the surfaces of the dimples. The minute projections 118 may be formed only on the surface of the land.

FIG. 7 shows three minute projections 118*a* belonging to a first row I, and three minute projections 118*b* belonging to a second row II. The direction indicated by an arrow A in FIG. 7 is the direction in which the rows extend. In each row, the minute projections 118 are aligned at equal pitches. In other words, the minute projections 118 are regularly aligned. At a part of the surface of the golf ball, the minute projections 118 may be irregularly aligned.

The minute projections 118*a*, which belong to the first row I, and the minute projections 118*b*, which belong to the second row II, may be arranged zigzag. In other words, the positions of the minute projections 118*a*, which belong to the first row I, may be displaced relative to the positions of the minute projections 118*b*, which belong to the second row II, in the extending direction A.

Figure 8:
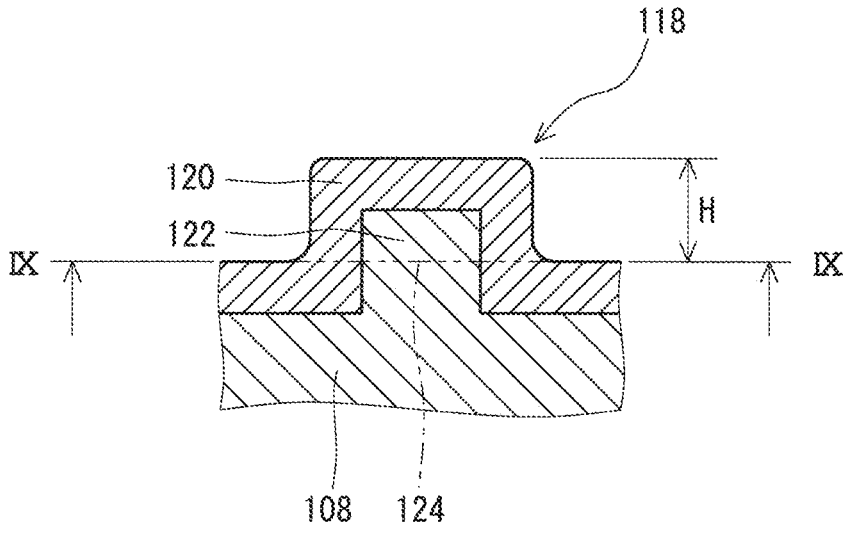
FIG. 8 is a partially enlarged cross-sectional view of the golf ball in FIG. 7.

FIG. 8 is a partially enlarged cross-sectional view of the golf ball in FIG. 7. FIG. 8 shows a cover 108, which is a part of the main body, and a paint layer 120. FIG. 8 shows the minute projection 118. The cover 108 has a projection portion 122. The minute projection 118 is formed by the projection portion 122 and the paint layer 120. The projection portion 122 stands outward in the radial direction of the golf ball (upward in FIG. 8). Thus, the minute projection 118 also stands outward in the radial direction of the golf ball. In other words, the minute projection 118 has a shape in which the surface shape of the main body (cover 108) is reflected. In FIG. 8, reference sign 124 indicates the bottom surface of the minute projection 118.

Figure 9:
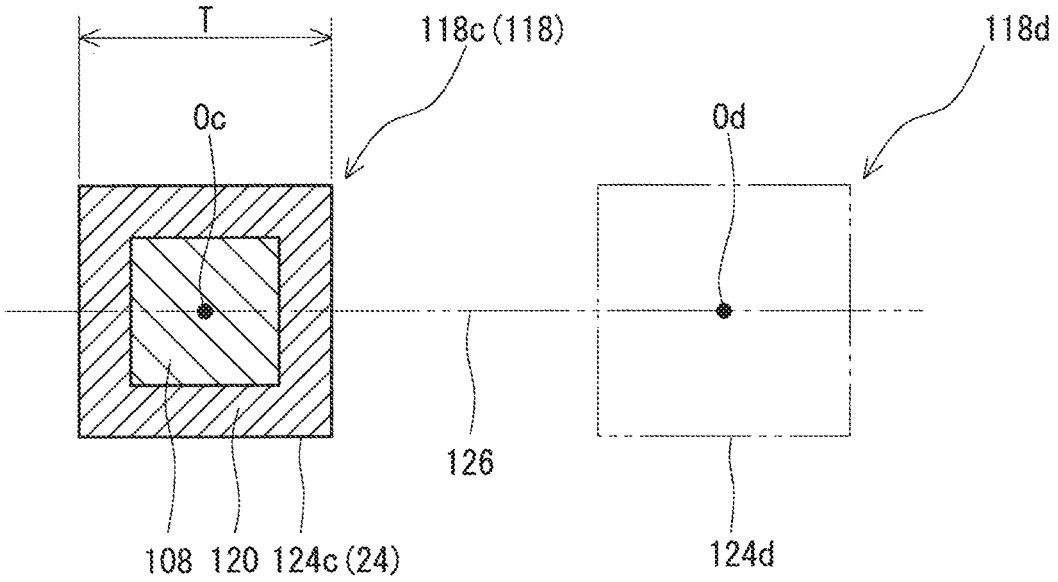
FIG. 9 is a cross-sectional view taken along the line IX-IX in FIG. 8.

FIG. 9 is a cross-sectional view taken along the line IX-IX in FIG. 8. FIG. 9 shows the bottom surface 124 of the minute projection 118. The bottom surface 124 includes the cover 108 and the paint layer 120.

In FIG. 7, an arrow P indicates a pitch. The pitch P is the distance between a first minute projection 118 and a second minute projection 118 adjacent to the first minute projection 118. The pitch P is the distance between the center of gravity of a bottom surface 124 of the first minute projection 118 and the center of gravity of a bottom surface 124 of the second minute projection 118. The "second minute projection adjacent to the first minute projection" is the minute projection 118 having a smallest distance to the first minute projection 118, among the minute projections 118 present around the first minute projection 118. The "distance" is the distance between the centers of gravity of the bottom surfaces 124 of the minute projections 118.

For each minute projection 118, one pitch P is determined. An average pitch Pav is calculated by summing the pitches P of all the minute projections 118 and dividing the sum of the pitches P by the number of the minute projections 118. The average pitch Pav is preferably not less than 100 μm. Even when mud is brought into contact with the golf ball in which the average pitch Pav is not less than 100 μm, the mud flows between the minute projections 118 and the minute projections 118 adjacent thereto as a passage. Mud is less likely to adhere to the golf ball. The golf ball has an excellent anti-soiling property. On the golf ball in which the average pitch Pav is not less than 100 μm, water also flows between the minute projections 118 and the minute projections 118 adjacent thereto as a passage. Therefore, even when the surface of the golf ball is soiled, if the golf ball is washed with water, the water flows, while taking in mud. The golf ball has excellent cleanability. In light of anti-soiling property and cleanability, the average pitch Pav is more preferably not less than 110 μm and particularly preferably not less than 120 μm. From the standpoint that a passage is easily formed, the average pitch Pav is preferably not greater than 2 mm.

In FIG. 7, an arrow L indicates the distance between the first minute projection 118 and the second minute projection 118 adjacent to the first minute projection 118. The direction of the distance L is the same as the direction of the pitch P.

For each minute projection 118, one distance L is determined. An average distance Lav is calculated by summing the distances L of all the minute projections 118 and dividing the sum of the distances L by the number of the minute projections 118. From the standpoint that a passage is easily formed, the average distance Lav is preferably not less than 40 μm, more preferably not less than 60 μm, and particularly preferably not less than 75 μm. The average distance Lav is preferably not greater than 400 μm.

FIG. 9 shows a bottom surface 124*c* of a first minute projection 118*c* and also shows a bottom surface 124*d* of a second minute projection 118*d* by an alternate long and two short dashes line. The second minute projection 118*d* is adjacent to the first minute projection 118*c*. In FIG. 9, an alternate long and two short dashes line 126 represents a straight line passing through the center of gravity Oc of the bottom surface 124*c* of the first minute projection 118*c* and the center of gravity Od of the bottom surface 124*d* of the second minute projection 118*d*. In FIG. 9, an arrow T indicates a width of the first minute projection 118*c*. The width T is measured along the straight line 126. The width T is the distance of a portion included in the contour of the bottom surface 124*c*, of the straight line 126.

Figure 10:
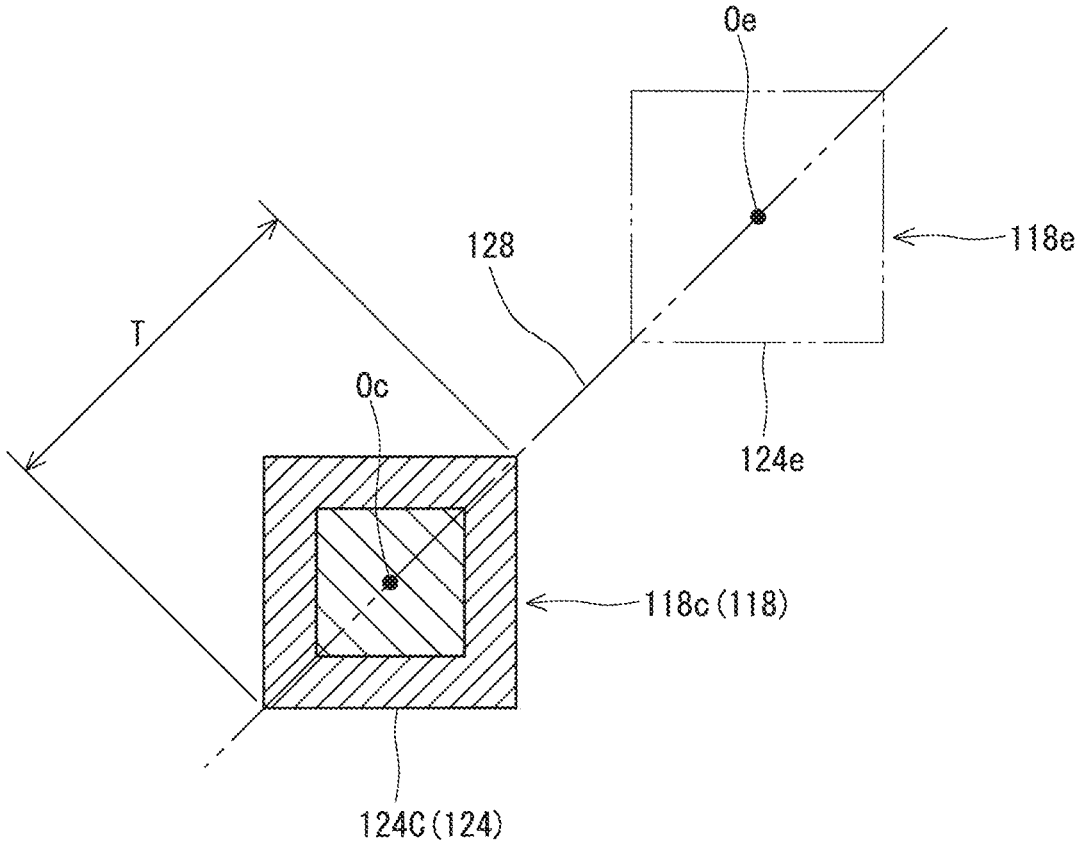
FIG. 10 is a partially enlarged cross-sectional view of the golf ball in FIG. 7.

FIG. 10 shows the bottom surface 124*c* of the first minute projection 118*c* and also shows a bottom surface 124*e* of a second minute projection 118*e* by an alternate long and two short dashes line. The second minute projection 118*e* is adjacent to the first minute projection 118*c*. In FIG. 10, an alternate long and two short dashes line 128 represents a straight line passing through the center of gravity Oc of the bottom surface 124*c* of the first minute projection 118*c* and the center of gravity Oe of the bottom surface 124*e* of the second minute projection 118*e*. In FIG. 10, an arrow T indicates a width of the first minute projection 118*c*. The width T is measured along the straight line 128. The width T is the distance of a portion included in the contour of the bottom surface 124*c*, of the straight line 128. The width T shown in FIG. 10 is larger than the width T shown in FIG. 9.

The distance between the first minute projection 118*c* and the second minute projection 118*d* shown in FIG. 9 is equal to the distance between the first minute projection 118*c* and the second minute projection 118*e* shown in FIG. 10. The first minute projection 118*c* is adjacent to the two, second minute projections 118*d* and 118*e*. Therefore, the first minute projection 118*c* can have a plurality of widths T. In this case, the largest width T is adopted as the width of the first minute projection 118*c*.

For each minute projection 118, one width T is determined. An average width Tav is calculated by summing the widths T of all the minute projections 118 and dividing the sum of the widths T by the number of the minute projections 118. In light of anti-soiling property, the average width Tav is preferably not less than 40 μm, more preferably not less than 50 μm, and particularly preferably not less than 75 μm. From the standpoint that a passage is easily formed, the average width Tav is preferably not greater than 400 μm.

The golf ball satisfies the following mathematical formula.

$$Lav>0.5*Tav$$

On the golf ball, a passage is easily formed between the minute projections 118 and the minute projections 118 adjacent thereto. When the golf ball is washed with water, the water flows while taking in mud. Therefore, the golf ball has an excellent anti-soiling property and cleanability. In light of anti-soiling property and cleanability, the golf ball preferably satisfies the following mathematical formula.

$$Lav\geq Tav$$

The golf ball preferably satisfies the following mathematical formula.

$$Lav<1.5*Tav$$

In FIG. 8, an arrow H indicates the height of the minute projection 118. The height H is measured along the radial direction of the golf ball. An average height Hav is calculated by summing the heights H of all the minute projections 118 and dividing the sum of the heights H by the number of the minute projections 118. From the standpoint that a passage is easily formed between the minute projections 118 and the minute projections 118 adjacent thereto, the average height Hav is preferably not less than 0.5 μm, more preferably not less than 1.0 μm, and particularly preferably not less than 2.0 μm. In light of flight performance of the golf ball, the average height Hav is preferably not greater than 50 μm, more preferably not greater than 40 μm, and particularly preferably not greater than 30 μm.

In light of anti-soiling property and cleanability, the average area of the bottom surfaces 124 is preferably not less than 100 $\mu m^2$, more preferably not less than 225 $\mu m^2$, and particularly preferably not less than 400 $\mu m^2$. In light of anti-soiling property, the average area is preferably not greater than 3600 $\mu m^2$, more preferably not greater than 2500 $\mu m^2$, and particularly preferably not greater than 1600 $\mu m^2$.

In light of anti-soiling property and cleanability, the ratio of the total area of the bottom surfaces 124 of all the minute projections 118 relative to the surface area of a phantom sphere is preferably not less than 5%, more preferably not less than 15%, and particularly preferably not less than 20%. In light of anti-soiling property, the ratio is preferably not greater than 80%, more preferably not greater than 60%, and particularly preferably not greater than 50%.

In light of anti-soiling property and cleanability, the total number of the minute projections 118 is preferably not less than 500, more preferably not less than 1000, and particularly preferably not less than 2000. In light of anti-soiling property, the total number is preferably not greater than 500000, more preferably not greater than 300000, and particularly preferably not greater than 100000.

As described above, each minute projection 118 includes the projection portion 122 of the main body and the paint layer 120 (see FIG. 8). Therefore, even when the paint layer 120 is separated from the main body, the shapes of the minute projections 118 are substantially maintained, and the passage is maintained. A special paint is not needed for forming the minute projections 118. The golf ball can easily be produced.

Soiling of the golf ball is prevented by a physical effect of the minute projections 118. Therefore, it is not necessary to use a cover 108 and a paint layer 120 that have special chemical properties for the purpose of preventing soiling.

The projection portions 122 of the main body are formed simultaneously with formation of the main body. For the formation, a mold is used. The cavity face of the mold has a large number of minute recesses. Each recess has a shape that is substantially the inverted shape of the projection portion 122. The mold can be obtained from a master mold. One example of a method for producing the master mold is etching. During etching, a large number of minute maskings are used. By the maskings, projection portions are formed on the master mold. By the projection portions of the master mold, recesses are formed on the mold. The positions of the maskings correspond to the positions of the projection portions of the master mold, correspond to the positions of the recesses of the mold, and correspond to the positions of the minute projections 118 of the golf ball. The master mold can be produced by various methods other than etching. Examples of a method other than etching include laser radiation processing.

As described above, the minute projections 118 are formed on the surfaces of the dimples and also on the surface of the land. The minute projections 118 prevent soiling of the dimples and also prevent soiling of the land.

The shape of each minute projection 118 shown in FIGS. 7 to 10 is substantially a square prism. The golf ball may have minute projections having other shape. Examples of the other shape include a prism other than a square prism, a circular column, a truncated pyramid, a truncated cone, a pyramid, and a cone. The shape of each minute projection may be a part of a sphere. Each minute projection may have a shape obtained by combining a plurality of solids.

EXAMPLES

Experiment 1

Example 1

A rubber composition was obtained by kneading 100 parts by weight of a high-cis polybutadiene (trade name "BR-730", manufactured by JSR Corporation), 25.5 parts by weight of zinc diacrylate, 12 parts by weight of zinc oxide, an appropriate amount of barium sulfate, 0.5 parts by weight of diphenyl disulfide, 0.9 parts by weight of dicumyl peroxide, 0.1 parts by weight of 2-naphthalenethiol, and 2 parts by weight of benzoic acid. This rubber composition was placed into a mold including upper and lower mold halves each having a hemispherical cavity, and heated at 160° C. for 20 minutes to obtain a core with a diameter of 38.7 mm. The amount of barium sulfate was adjusted such that a core having a predetermined weight was obtained.

A resin composition was obtained by kneading 26 parts by weight of an ionomer resin (trade name "Himilan AM7337", manufactured by Du Pont-MITSUI POLYCHEMICALS Co., Ltd.), 26 parts by weight of another ionomer resin (trade name "Himilan AM7329", manufactured by Du Pont-MITSUI POLYCHEMICALS Co., Ltd.), 48 parts by weight of a styrene block-containing thermoplastic elastomer (trade name "RABALON T3221C", manufactured by Mitsubishi Chemical Corporation), 4 parts by weight of titanium dioxide, and 0.2 parts by weight of a light stabilizer (trade name "JF-90", manufactured by Johoku Chemical Co., Ltd.) with a twin-screw kneading extruder. The core was covered with this resin composition by injection molding to form a mid layer with a thickness of 1.0 mm.

A resin composition was obtained by kneading 55 parts by weight of an ionomer resin (trade name "Himilan AM7329", manufactured by Du Pont-MITSUI POLYCHEMICALS Co., Ltd.), 45 parts by weight of another ionomer resin (trade name "Himilan 1555", manufactured by Du Pont-MITSUI POLYCHEMICALS Co., Ltd.), 4 parts by weight of titanium dioxide, and 0.2 parts by weight of a light stabilizer (trade name "JF-90", manufactured by Johoku Chemical Co., Ltd.) with a twin-screw kneading extruder. The sphere consisting of the core and the mid layer was placed into a final mold that includes upper and lower mold halves each having a hemispherical cavity and having a large number of pimples and minute recesses on its cavity face. The mid layer was covered with this resin composition by injection molding to form a cover with a thickness of 1.0 mm. Dimples having a shape that is the inverted shape of the pimples were formed on the cover. Furthermore, minute projection portions having a shape that is the inverted shape of the minute recesses were formed on the cover.

A clear paint including a two-component curing type polyurethane as a base material was applied to this cover to obtain a golf ball of Example 1 with a diameter of about 42.7 mm and a weight of about 45.6 g. The golf ball has a large number of minute projections on the surface thereof. The specifications of these minute projections are shown in Table 1 below.

Examples 2 and 6 to 8 and Comparative Example 1

Golf balls of Examples 2 and 6 to 8 and Comparative Example 1 were obtained in the same manner as Example 1, except the final mold was changed and minute projections having an average pitch Pav, an average distance Lav, and an average width Tav shown in Tables 1 and 2 below were formed.

Examples 3 to 5

Golf balls of Examples 3 to 5 were obtained in the same manner as Example 1, except the final mold was changed and minute projections having an average height Hav shown in Table 1 below were formed.

Comparative Example 2

A golf ball of Comparative Example 2 was obtained in the same manner as Example 1, except the final mold was changed and no minute projection was formed.

[Anti-Soiling Property]

The golf balls according to each Example and each Comparative Example were put into a bucket together with soil, and the soil was stirred. Thereafter, the degree of soiling of each golf ball was categorized on the basis of the following criteria.

A: There was very little dirt.
B: There was little dirt.
C: There was much dirt.
D: There was very much dirt.

The results are shown in Tables 1 and 2 below.

[Cleanability]

The golf balls subjected to the above anti-soiling property evaluation were put into a bucket together with water, and the water was stirred. Thereafter, the degree of soiling of each golf ball was categorized on the basis of the following criteria.

A: There was very little dirt.
B: There was little dirt.
C: There was much dirt.
D: There was very much dirt.

The results are shown in Tables 1 and 2 below.

TABLE 1

Results of Evaluation

| | Ex. 2 | Ex. 3 | Ex. 1 | Ex. 4 | Ex. 5 |
|---|---|---|---|---|---|
| Minute projections | Presence | Presence | Presence | Presence | Presence |
| Pav (μm) | 30 | 50 | 50 | 50 | 50 |
| Lav (μm) | 15 | 25 | 25 | 25 | 25 |
| Tav (μm) | 15 | 25 | 25 | 25 | 25 |
| Hav (μm) | 10 | 5 | 10 | 30 | 55 |
| Lav < 3 * Tav | Satisfied | Satisfied | Satisfied | Satisfied | Satisfied |
| Anti-soiling property | B | B | A | B | C |
| Cleanability | B | A | A | A | C |

TABLE 2

Results of Evaluation

| | Ex. 6 | Ex. 7 | Ex. 8 | Comp. Ex. 1 | Comp. Ex. 2 |
|---|---|---|---|---|---|
| Minute projections | Presence | Presence | Presence | Presence | Absence |
| Pav (μm) | 75 | 80 | 95 | 120 | — |
| Lav (μm) | 50 | 40 | 70 | 60 | — |
| Tav (μm) | 25 | 40 | 25 | 60 | — |
| Hav (μm) | 10 | 10 | 10 | 10 | — |
| Lav < 3 * Tav | Satisfied | Satisfied | Satisfied | Satisfied | — |
| Anti-soiling property | A | B | B | D | D |
| Cleanability | B | B | C | C | D |

As shown in Tables 1 and 2, the golf ball of each Example has an excellent anti-soiling property and cleanability. From the results of evaluation, advantages of the present invention are clear.

Experiment 2

Example 9

A rubber composition was obtained by kneading 100 parts by weight of a high-cis polybutadiene (trade name "BR- 730", manufactured by JSR Corporation), 25.5 parts by weight of zinc diacrylate, 12 parts by weight of zinc oxide, an appropriate amount of barium sulfate, 0.5 parts by weight of diphenyl disulfide, 0.9 parts by weight of dicumyl peroxide, 0.1 parts by weight of 2-naphthalenethiol, and 2 parts by weight of benzoic acid. This rubber composition was placed into a mold including upper and lower mold halves each having a hemispherical cavity, and heated at 160° C. for 20 minutes to obtain a core with a diameter of 38.7 mm. The amount of barium sulfate was adjusted such that a core having a predetermined weight was obtained.

A resin composition was obtained by kneading 26 parts by weight of an ionomer resin (trade name "Himilan AM7337", manufactured by Du Pont-MITSUI POLYCHEMICALS Co., Ltd.), 26 parts by weight of another ionomer resin (trade name "Himilan AM7329", manufactured by Du Pont-MITSUI POLYCHEMICALS Co., Ltd.), 48 parts by weight of a styrene block-containing thermoplastic elastomer (trade name "RABALON T3221C", manufactured by Mitsubishi Chemical Corporation), 4 parts by weight of titanium dioxide, and 0.2 parts by weight of a light stabilizer (trade name "JF-90", manufactured by Johoku Chemical Co., Ltd.) with a twin-screw kneading extruder. The core was covered with this resin composition by injection molding to form a mid layer with a thickness of 1.0 mm A resin composition was obtained by kneading 55 parts by weight of an ionomer resin (trade name "Himilan AM7329", manufactured by Du Pont-MITSUI POLYCHEMICALS Co., Ltd.), 45 parts by weight of another ionomer resin (trade name "Himilan 1555", manufactured by Du Pont-MITSUI POLYCHEMICALS Co., Ltd.), 4 parts by weight of titanium dioxide, and 0.2 parts by weight of a light stabilizer (trade name "JF-90", manufactured by Johoku Chemical Co., Ltd.) with a twin-screw kneading extruder. The sphere consisting of the core and the mid layer was placed into a final mold that includes upper and lower mold halves each having a hemispherical cavity and having a large number of pimples and minute recesses on its cavity face. The mid layer was covered with this resin composition by injection molding to form a cover with a thickness of 1.0 mm.

Dimples having a shape that is the inverted shape of the pimples were formed on the cover. Furthermore, minute projection portions having a shape that is the inverted shape of the minute recesses were formed on the cover.

A clear paint including a two-component curing type polyurethane as a base material was applied to this cover to obtain a golf ball of Example 9 with a diameter of about 42.7 mm and a weight of about 45.6 g. The golf ball has a large number of minute projections on the surface thereof. The specifications of these minute projections are shown in Table 3 below.

Examples 10 to 12 and 16 and Comparative Example 3

Golf balls of Examples 10 to 12 and 16 and Comparative Example 3 were obtained in the same manner as Example 9, except the final mold was changed and minute projections having an average pitch Pav, an average distance Lav, and an average width Tav shown in Tables 3 and 4 below were formed.

Examples 13 to 15

Golf balls of Examples 13 to 15 were obtained in the same manner as Example 9, except the final mold was changed and minute projections having an average height Hav shown in Tables 3 and 4 below were formed.

Comparative Example 4

A golf ball of Comparative Example 4 was obtained in the same manner as Example 9, except the final mold was changed and no minute projection was formed.

[Anti-Soiling Property]

Soil and water were mixed to obtain mud. The golf balls according to each Example and each Comparative Example were put into a bucket together with the mud, and the mud was stirred. Thereafter, the degree of soiling of each golf ball was categorized on the basis of the following criteria.

A: There was very little dirt.

B: There was little dirt.

C: There was much dirt.

D: There was very much dirt.

The results are shown in Tables 3 and 4 below.

[Cleanability]

The golf balls subjected to the above anti-soiling property evaluation were put into a bucket together with water, and the water was stirred. Thereafter, the degree of soiling of each golf ball was categorized on the basis of the following criteria.

A: There was very little dirt.

B: There was little dirt.

C: There was much dirt.

D: There was very much dirt.

The results are shown in Tables 3 and 4 below.

TABLE 3

Results of Evaluation

| | Comp. Ex. 3 | Ex. 10 | Ex. 11 | Ex. 12 | Ex. 13 |
|---|---|---|---|---|---|
| Minute projections | Presence | Presence | Presence | Presence | Presence |
| Pav (μm) | 60 | 140 | 150 | 160 | 200 |
| Lav (μm) | 30 | 40 | 75 | 60 | 100 |
| Tav (μm) | 30 | 100 | 75 | 100 | 100 |
| Hav (μm) | 10 | 10 | 10 | 10 | 5 |
| Lav > 0.5 * Tav | Satisfied | Unsatisfied | Satisfied | Satisfied | Satisfied |
| Anti-soiling property | D | B | B | A | B |
| Cleanability | C | C | B | B | A |

TABLE 4

Results of Evaluation

| | Ex. 9 | Ex. 14 | Ex. 15 | Ex. 16 | Comp. Ex. 4 |
|---|---|---|---|---|---|
| Minute projections | Presence | Presence | Presence | Presence | Absence |
| Pav (μm) | 200 | 200 | 200 | 800 | — |
| Lav (μm) | 100 | 100 | 100 | 400 | — |
| Tav (μm) | 100 | 100 | 100 | 400 | — |
| Hav (μm) | 10 | 30 | 55 | 10 | — |
| Lav > 0.5 * Tav | Satisfied | Satisfied | Satisfied | Satisfied | — |
| Anti-soiling property | A | B | C | C | D |
| Cleanability | A | A | C | C | D |

As shown in Tables 3 and 4, the golf ball of each Example has an excellent anti-soiling property and cleanability. From the results of evaluation, advantages of the present invention are clear.

The aforementioned minute projections are applicable to golf balls having various structures such as a one-piece golf ball, a two-piece golf ball, a four-piece golf ball, a five-piece golf ball, a six-piece golf ball, a thread-wound golf ball, and the like in addition to a three-piece golf ball. The above descriptions are merely illustrative examples, and various modifications can be made without departing from the principles of the present invention.

What is claimed is:

1. A golf ball having a plurality of dimples and a land, wherein the golf ball further has not less than 500 and not greater than 500,000 minute projections formed on surfaces of the dimples and/or the land, an average pitch Pav of the minute projections is not less than 30 μm and not greater than 80 μm;

an average distance Lav of the minute projections is not less than 15 μm and not greater than 50 μm; and an average height Hav of the minute projections is not less than 5 μm and not greater than 30 μm;

wherein the pitch is a distance between a center of gravity of a bottom surface of a first minute projection and a center of gravity of a bottom surface of a second minute projection;

wherein the second minute projection is the minute projection having a smallest distance to the first minute projection among the minute projections around the first minute projection; wherein the golf ball has a plurality of rows in each of which a plurality of minute projections are aligned at equal pitches; and wherein the minute projections have a shape comprising a prism, a circular column, a truncated pyramid, a truncated cone, a pyramid, a cone, or a part of a sphere.

2. The golf ball according to claim 1, wherein the golf ball satisfies the following mathematical formula:

$$Lav<3*Tav,$$

wherein Lav represents an average value of distances L between the minute projections and other minute projections adjacent to the minute projections, and Tav represents an average value of widths T of the minute projections.

3. The golf ball according to claim 1, wherein the golf ball includes a main body and a paint layer positioned outside the main body, and the minute projections each stand outward in the radial direction of the golf ball.

4. A golf ball having a plurality of dimples and a land, wherein the golf ball further has not less than 500 and not greater than 500,000 minute projections formed on surfaces of the dimples and/or the land, an average pitch Pay of the minute projections is not less than 140 μm;

an average distance Lav of the minute projections is not less than 40 μm and not greater than 400 μm; and an average height Hav of the minute projections is not less than 5 μm and not greater than 50 μm;

wherein the pitch is a distance between a center of gravity of a bottom surface of a first minute projection and a center of gravity of a bottom surface of a second minute projection;

wherein the second minute projection is the minute projection having a smallest distance to the first minute projection among the minute projections around the first minute projection; wherein the golf ball has a plurality of rows in each of which a plurality of minute projections are aligned at equal pitches;

wherein the golf ball has a main body and a paint layer, the main body includes a cover having a projection portion, and each minute projection is formed by the projection portion of the cover and the paint layer; and wherein the minute projections have a shape comprising a prism, a circular column, a truncated pyramid, a truncated cone, a pyramid, a cone, or a part of a sphere.

5. The golf ball according to claim 4, wherein the golf ball satisfies the following mathematical formula:

$$Lav>0.5*Tav,$$

wherein Lav represents an average value of distances L between the minute projections and other minute projections adjacent to the minute projections, and Tav represents an average value of widths T of the minute projections.

6. The golf ball according to claim 4, wherein the golf ball includes a main body and a paint layer positioned outside the main body, and the minute projections each stand outward in the radial direction of the golf ball.

7. The golf ball according to claim 1, wherein an average value of widths of the minute projections is 10-60 μm.

8. The golf ball according to claim 4, wherein an average value of widths of the minute projections is 40-400 μm.

9. The golf ball according to claim 1, wherein the golf ball has a main body and a paint layer, the main body includes a cover having a projection portion, and each minute projection is formed by the projection portion of the cover and the paint layer.

* * * * *